United States Patent [19]

Hoopengardner

[11] Patent Number: 4,557,774

[45] Date of Patent: Dec. 10, 1985

[54] SYSTEM FOR HOLDING CARPET IN PLACE WITHOUT STRETCHING

[75] Inventor: Merle R. Hoopengardner, Lafayette, Calif.

[73] Assignee: Jac Tac, Inc., Lafayette, Calif.

[21] Appl. No.: 647,119

[22] Filed: Sep. 4, 1984

[51] Int. Cl.[4] ..... E04B 2/00; E04F 13/00; B32B 5/14; B32B 7/12

[52] U.S. Cl. ..... 156/71; 156/92; 156/291; 428/95; 428/198; 428/317.3; 428/318.8; 428/354; 428/906

[58] Field of Search ..... 52/746; 156/71, 92, 156/291; 428/40, 47, 48, 62, 95, 317.1, 317.3, 317.5, 317.7, 318.6, 318.8, 343, 352, 354, 906, 158, 159, 160, 198

[56] References Cited

U.S. PATENT DOCUMENTS

| | | | |
|---|---|---|---|
| 3,394,043 | 7/1968 | Parlin et al. | 428/95 |
| 3,402,094 | 9/1968 | Levitch | 428/80 |
| 3,591,443 | 7/1971 | Cox | 428/314.4 |
| 3,616,029 | 10/1971 | Lerman | 428/316.6 |
| 3,847,647 | 11/1974 | Bahlo | 428/47 |
| 4,075,377 | 2/1978 | Aitchison et al. | 428/95 |
| 4,100,006 | 7/1978 | Buckley | 428/319.7 |
| 4,234,649 | 11/1980 | Ward | 428/355 |
| 4,405,668 | 9/1983 | Wald | 428/354 |
| 4,504,537 | 3/1985 | Mussallem, Jr. | 428/95 |

FOREIGN PATENT DOCUMENTS

| | | | |
|---|---|---|---|
| 747341 | 11/1966 | Canada | 428/318.8 |
| 788001 | 12/1957 | United Kingdom | 428/352 |
| 840210 | 7/1960 | United Kingdom | 428/317.3 |
| 900876 | 7/1962 | United Kingdom | 428/319.1 |
| 1032868 | 6/1966 | United Kingdom | 428/318.6 |

*Primary Examiner*—William J. Van Balen
*Attorney, Agent, or Firm*—Donald C. Feix

[57] ABSTRACT

A carpet and pad installation avoids the need for stretching and tackless strips by utilizing a pad with pressure-sensitive adhesive on its upper and lower surfaces. The pad is first laid on the floor surface and trimmed as required, with its lower adhesive surface adhering to the floor. Its upper surface has a removable release film covering the pressure-sensitive adhesive, permitting the carpet to be unrolled over the release film and then cut and seamed as required. The seamed carpet is folded back and the release film is removed from the exposed area of the carpet cushion, then the carpet is pressed down onto the exposed area of adhesive. Then another portion of the carpet is folded back, the release film is removed from that area, and that portion of the carpet is pressed onto the exposed pressure-sensitive adhesive of the carpet cushion.

21 Claims, 8 Drawing Figures

FIG. 1
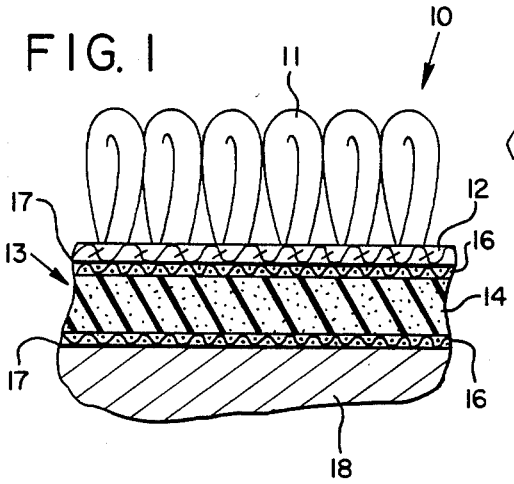
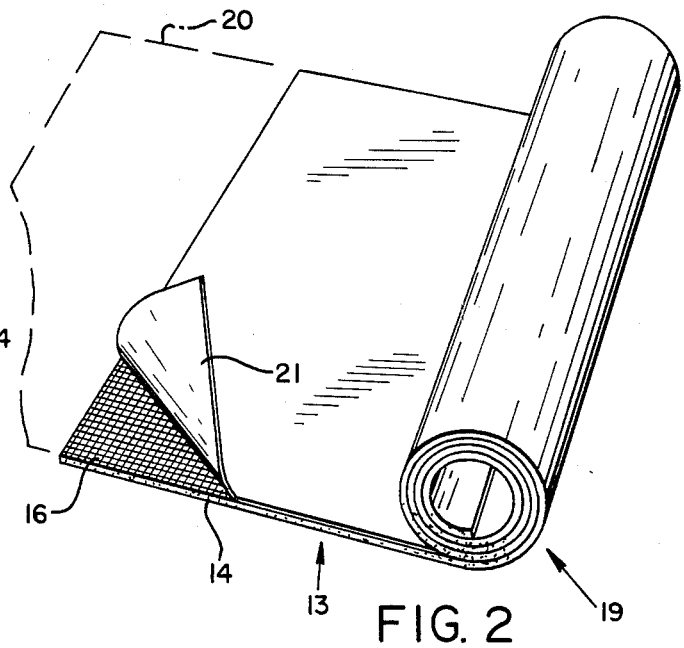
FIG. 2
FIG. 3
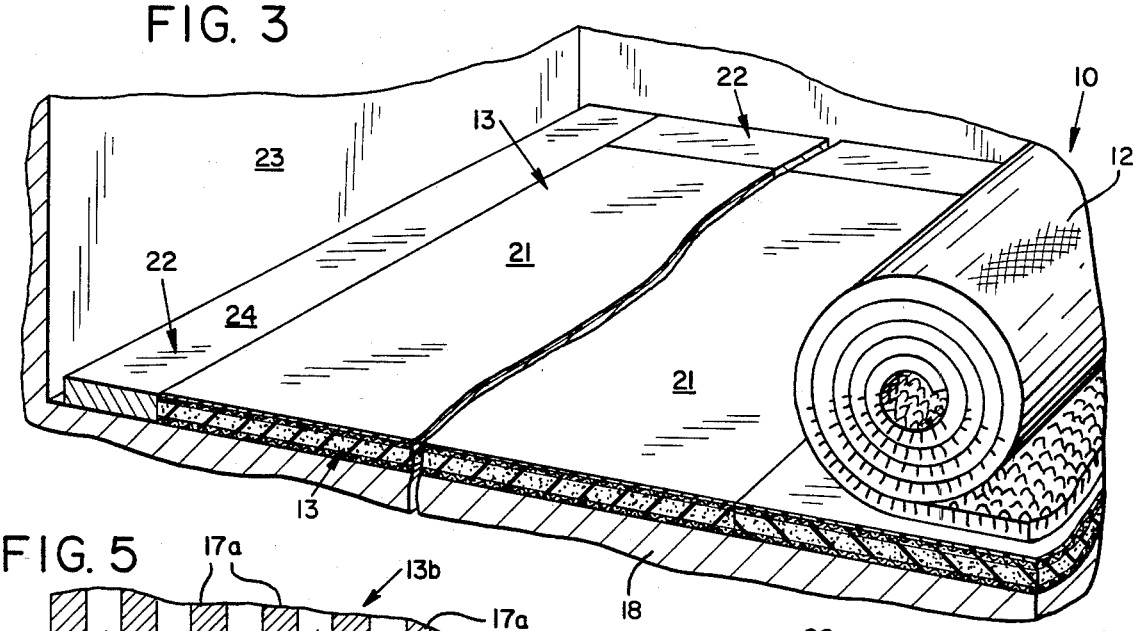
FIG. 5
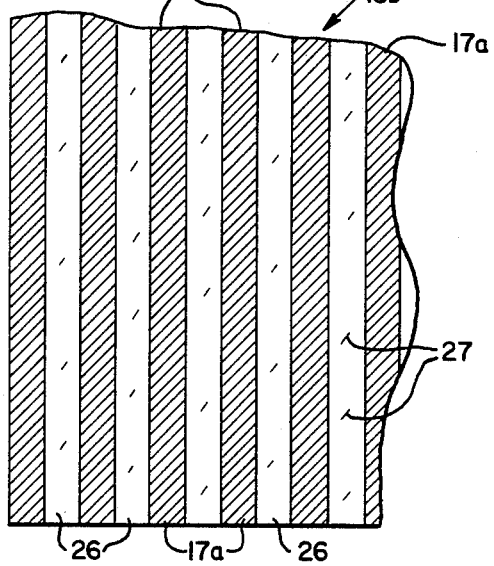
FIG. 6
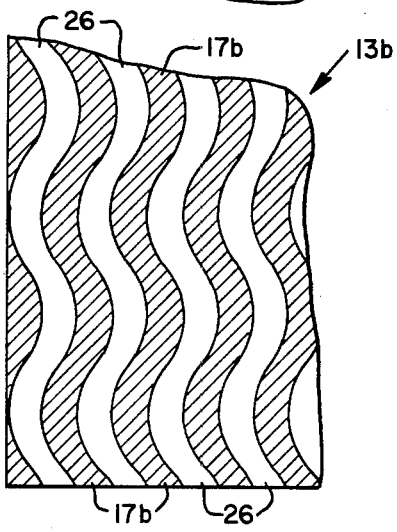

SYSTEM FOR HOLDING CARPET IN PLACE WITHOUT STRETCHING

BACKGROUND OF THE INVENTION

The invention relates to carpet installation and carpet cushion or padding, and more particularly to a system for adhering a pad to the floor and a carpet to the pad, eliminating any need for carpet stretching.

In the prior art, carpeting has been installed on floors in several different ways. In the conventional tackless strip system, the so-called tackless strip is secured to the floor around the walls of the room, the carpet is hooked onto the upwardly protruding nails of the tackless strip at one side of the room, and the carpet is stretched before it is hooked to the tackless strip at the opposite side of the room. The problems with this system are that it requires the installation of the tackless strip, which is time-consuming and which is difficult when concrete floors are encountered, and also that it requires a trained professional to re-stretch the carpet in the event a corner or edge portion of the carpet needs to be temporarily taken up for installation of wiring, access to the floor or for drying a carpet which has been wetted.

Many carpet installations involve gluing of the carpeting to the floor, without any carpet cushion or pad between the carpet and the floor. With this system, the carpeting can be of less expensive construction, with a primary backing but without the need for a secondary backing which is generally required for stretched carpeting. The glued-down carpeting avoids wrinkling without the need for stretching, but loses the benefit of a carpet pad. Also, the carpet can be very difficult to remove either for replacement or temporarily, for maintenance, without destroying the floor or the carpeting itself due to the adhesion of the glue.

In glue-down installations, the carpet is ordinarily laid on the floor first and seamed as required. The glue is then applied to the floor, either in liquid form or by spraying it onto the floor. This can be accomplished by folding back half of the carpet, applying the glue to the floor in that area, and dropping the carpet in place to adhere it to the floor in that area. The opposite side of the carpet could then be folded back, glue applied to the floor in that area, and that portion of the carpet then adhered to the floor.

Another installation system wherein the carpet was adhered to the floor without padding is disclosed in U.S. Pat. No. 4,405,668. This system used a separate, thin scrim web with adhesive on both sides and with a release film on one side. The scrim web was placed on a floor with the release film on the upper surface, adhering the web to the floor, whereupon the carpet could then be seamed and cut as required while lying on top of the release film. The carpet was then folded back and the release film removed in one area, that portion of the carpet was pressed down, and the operation was repeated in another area. This system was relatively expensive and still did not permit the installation of a carpet pad beneath the carpeting. A similar construction of adhesive webbing material is shown in U.S. Pat. No. 4,234,649.

In yet another system for installing carpet without stretching, a slab or pad of jute material was interposed between the carpet backing and the floor. In this particular system the floor was sprayed with a wet adhesive, the slab of jute material was laid into the adhesive while the adhesive was still wet, the top surface of the jute material was sprayed with the wet adhesive; and the carpet was laid on the wet adhesive on the top surface of the jute slab or pad. The wet adhesive, as it dried, became enough of a pressure sensitive adhesive to permit the carpet to be pulled up and removed.

This system had the disadvantage of being an expensive system because of the costs required to make an on-the-job installation.

SUMMARY OF THE INVENTION

It is a primary object of the present invention to hold carpet in place without stretching by a system that avoids the problems of the prior art.

It is a closely related object to hold the carpet in place by a system that utilizes a pad with pressure sensitive adhesive on the upper and lower surfaces of the pad.

By the method of the present invention, carpeting is efficiently and economically installed without stretching or the need for tackless strips and without liquid glues or spray adhesives, but still with the benefit of a carpet cushion or pad between the floor and the carpet.

First there is positioned on the floor surface a carpet cushion having a pressure-sensitive adhesive on both its upper and lower surfaces, with a release film adhered to the adhesive on the upper surface. The carpet cushion also includes a means for maintaining dimensional stability. The cushion is laid and trimmed as required.

Next the carpet is positioned on top of the release film on the carpet cushion, and rough cut and seamed as required. The carpet is then folded back to expose a portion of the carpet cushion, usually one half, and the release film is removed from the exposed cushion.

The carpet is then pressed down onto the exposed pressure-sensitive adhesive on the upper surface of the carpet cushion, and another portion of the carpet is folded back and the release film is removed from that area of the carpet cushion. That portion of the carpet is then pressed down.

When all areas of the carpet are in contact with the adhesive, final trimming of the carpet edges is performed.

The described method may include installing rigid spacer strips on the floor along the walls of the room before laying the carpet cushion, preferably strips of wood or plastic with pressure-sensitive adhesive on both sides. The purpose of the spacer strips is to provide an edge similar to that of the tackless strips, since the carpet installer's trimming tools have been designed to trim the carpet with the hard strip present, cutting the carpet ¼ inch long and tucking the carpet edge under, against the wall or baseboard. If a tackless strip from a previous carpet installation is present, it may be left in place with no need for the spacer strips.

The means for maintaining dimensional stability in the carpet cushion preferably comprises a scrim webbing of a fibrous plastic material, such as polyester "leno weave" square webbing, bonded to each surface of the synthetic foam pad of the cushion material. In the manufacture of the carpet cushion, a sealant preferably is applied to both scrim-covered surfaces of the foam pad to substantially seal the surface, before the pressure-sensitive adhesive is added. This keeps the adhesive at the surface of the foam.

In another embodiment the means for maintaining dimensional stability simply comprises a stiffened surface or crust at both the lower and upper surfaces of the foam cushion. This can be accomplished by a heat process, for example, which may eliminate the need for any sprayed-on sealant on the surfaces of the foam.

The adhesive need not cover the entire surfaces of the carpet cushion, but may be in spaced strips on each surface. Adhesive cost is thereby reduced without adversely affecting the positional stability of the carpet installation. Also, this enables the carpet cushion to be stapled or tacked to the floor, if needed in particular areas, in the spaces between strips of adhesive on the upper surface. The carpet will then bridge the gap over the recess or dimple caused by the stapling, since there is no adhesive in this area.

The adhesive on the cushion's surfaces may be in parallel serpentine strips to discourage wrinkling of the carpet, which tends to occur in straight lines.

The system of the invention enables the use of less expensive carpeting than usually required in stretch-/tackless strip installations. The typical stretched carpet includes the upper surface yarn, extending through a bonding mesh such as a polypropylene mesh, with a primary backing of latex and a secondary backing of a jute mesh for resiliency in the stretching operation.

With the present system of adhesive bonding of the carpet to the pad (and the pad to the floor), the carpet does not need an expensive secondary backing, since it is adhered down in substantially all areas and is not stretched.

It is therefore among the objects of the invention to improve on prior carpeting installation methods and systems by the use of a system including a carpet cushion or pad having pressure-sensitive adhesive at both surfaces, for adhering the cushion to the floor and the carpet to the upper surface of the cushion, avoiding the need for stretching or for relatively expensive carpeting which includes a secondary backing.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

DESCRIPTION OF THE DRAWINGS

FIG. 1 is a fragmentary sectional view showing a carpet and pad installed according to the system of the invention.

FIG. 2 is a perspective view showing a carpet pad according to the invention and comprising a part of the installation shown in FIG. 1. The pad is shown coming off a roll, with a release film covering one side of the adhesive-coated pad, on the inside of the roll.

FIG. 3 is a perspective view showing a floor in preparation for carpet installation according to the invention, with the pad laid on the floor and the carpet being unrolled on top of the pad over the release film.

FIG. 5 is a plan view showing a pad according to the invention with its pressure-sensitive adhesive applied in parallel strips rather than over the entire surface of the pad, and showing optional stapling between the strips of adhesive.

FIG. 6 is a plan view similar to FIG. 4, but showing the adhesive applied in serpentine strips.

DESCRIPTION OF THE PREFERRED EMBODIMENTS

Figure 4:
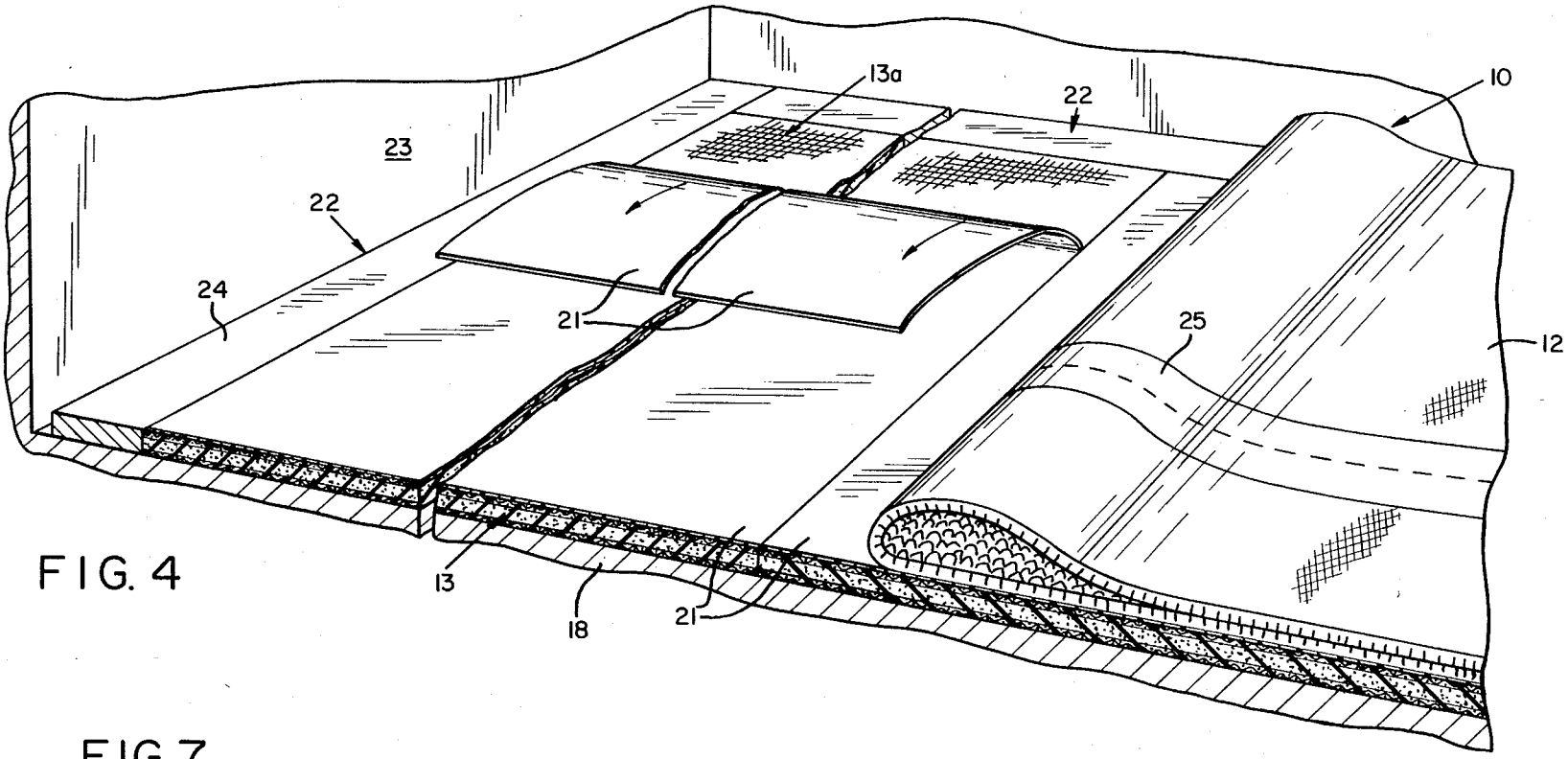
FIG. 4 is a perspective view similar to FIG. 3, but showing the carpet pulled back for peeling away the release film from the top surface of the pad, in a portion of the floor where the carpet, already seamed and cut, has been pulled or rolled back.

In the drawings, FIG. 1 shows a carpet 10 with a pile 11 and a single backing layer or primary backing 12 laid on a pad or carpet cushion 13 comprising a foam pad 14 and a scrim webbing 16 bonded to both top and bottom surfaces of the pad 14, with a pressure-sensitive adhesive layer 17 also at top and bottom surfaces on the scrim 16 and on the surfaces of the pad 14 itself, between the mesh of the scrim webbing. The adhesive 17 holds the carpet backing 12 to the carpet cushion 13, and the carpet cushion to the surface of the floor 18 below.

FIG. 2 shows a roll 19 of the carpet cushion 13 of the invention, showing the foam pad 14 and the upper layer of scrim webbing 16 which is bonded to the pad 14 in the manufacturing process. The adhesive layer 17 has been applied after the scrim webbing 16, coating the outer surfaces of the webbing mesh 16 and the exposed areas of the pad surface 14 among the mesh. A release film 21 of a sheet plastic material overlies the upper surface of the carpet cushion 13, i.e., the inner surface of the cushion on the roll 19, being temporarily adhered to that surface. The bottom of the cushion 13, and thus the outer surface of the roll 19 as seen in FIG. 2, is not covered by any release film. This enables the cushion to be laid on a floor and adhered to the floor while still leaving the upper surface as a work surface for unrolling the carpet 10 and performing preliminary cutting and seaming operations as necessary. For storage and transport of the roll 19 prior to installation, the release film may have a tail or extension 20 (dashed lines) which wraps around the roll and covers the exposed adhesive.

The scrim webbing 16 gives dimensional stability to the adhesive carpet cushion 13, and helps enable the carpeting to be removed from the cushion, or the cushion to be removed from the floor 18, without destruction of the carpet or the cushion or the floor itself. The pressure-sensitive adhesive 17 is a non-permanent adhesive so as to always allow for temporary lifting of the carpet wholly or in localized areas when desired.

FIG. 3 illustrates some aspects of the installation operation according to the system of the invention. First, rigid spacer strips 22 may be installed around the edges of the room near the walls 23. The spacer strips 22 may be of wood or plastic, for example, with a pressure-sensitive adhesive 24 on both the upper and lower surfaces. The purpose of the strip 24 is merely to take the place of the conventional tackless strips, in the sense that conventional carpeting tools for trimming the finished carpet are designed to be used along the edges of the tackless strips. If tackless strips are in place from a prior carpet installation, they should be left intact, and the spacer strips 22 would then not be needed.

It should also be understood that the carpet installation according to the invention may be performed without the use of any spacer strips 22 or tackless strips provided the installer uses tools adequate to properly trim the carpet without the presence of the usual rigid strip.

The carpet cushion 13 is unrolled onto the floor along the spacer strips 22, which are of about the same thickness as the cushion, generally in the manner shown in FIG. 2.

As indicated in FIG. 3, the adhesive carpet cushion 13 is first laid and trimmed on the floor 18, with its lower side adhered to the floor 18 but the release film 21 remaining on the upper surface. The carpet 10 is then unrolled over the top of the release film, and seaming and preliminary cutting is performed as necessary.

With the carpet seamed and rough cut it is then folded back or rolled back as indicated in FIG. 4 to expose a portion 13*a* of the cushion. Carpet seaming is indicated at 25. This enables the release film 21 to be peeled off the upper surface of that portion of the cushion 13*a* as indicated in FIG. 4. Once this is accomplished, the carpet is put back into position on the sticky upper surface of the cushion portion 13*a* and the same operation is repeated with another portion of the carpet 10 which may be the other half of the room. That is, the carpet is pulled or folded or rolled back to expose another portion or the remainder of the carpet cushion and its release film 21 is peeled off. Then the remaining portion of the carpeting is moved back into position, until all areas of the carpet are in contact with the upper surface of the carpet cushion, and final trimming operations are conducted.

FIG. 5 shows a carpet cushion 13*b* according to the invention, with spaced strips of adhesive 17*a* upon the surface, separated by spaces 26 of the surface which have no adhesive. This saves on the amount of adhesive required while still providing for adequate adhesion of the carpet cushion 13*b* to both the floor and the carpet backing. Also, it enables staples 27 or tacks to be used to hold the carpet cushion 13*b* down to the floor if required under special circumstances, without causing the carpet to recess or "dimple" inwardly at the location of the staple. Dimpling is avoided because there is no adhesive in the immediate vicinity of each staple 27, so the carpet does not adhere into the recess in the cushion caused by the staple, but rather the carpet bridges across the recess.

FIG. 6 shows a serpentine pattern for adhesive strips 17*b* on a carpet cushion 13*b*, which may be desired to prevent a pattern of wrinkling in the installed carpet. Wrinkles tend to occur in straight lines, so that the serpentine pattern shown in FIG. 6 discourages the occurence of wrinkles.

Figure 7:
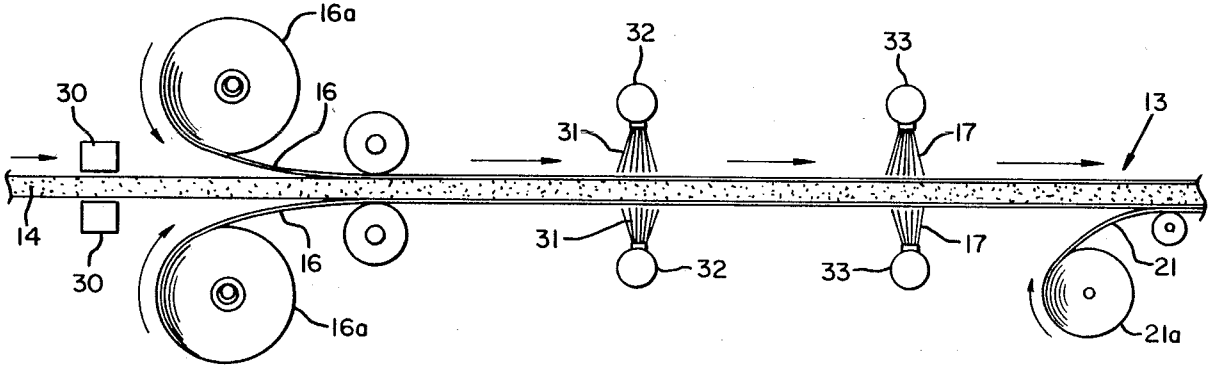
FIG. 7 is a schematic view indicating a method for producing the carpet pad of the invention.
Figure 4:
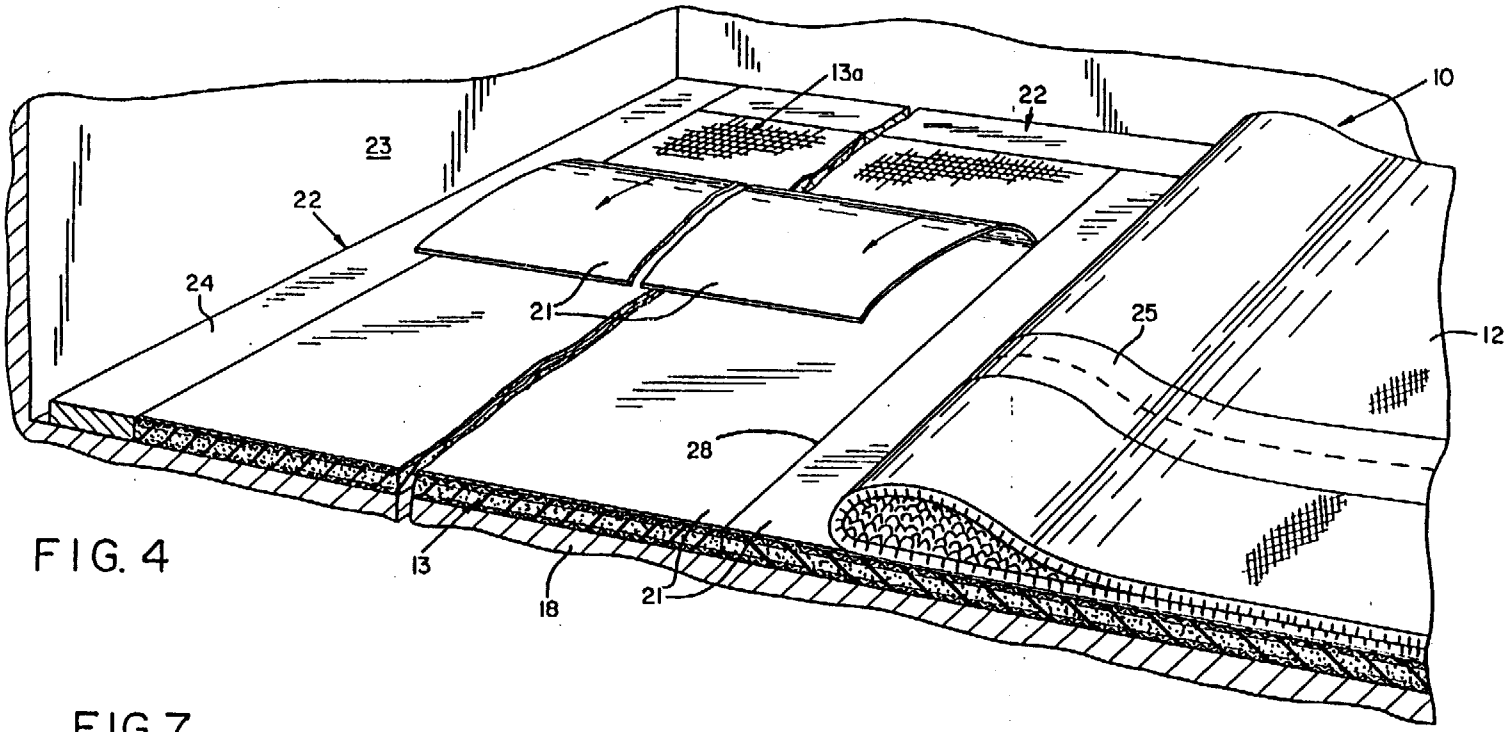
Figure 8:
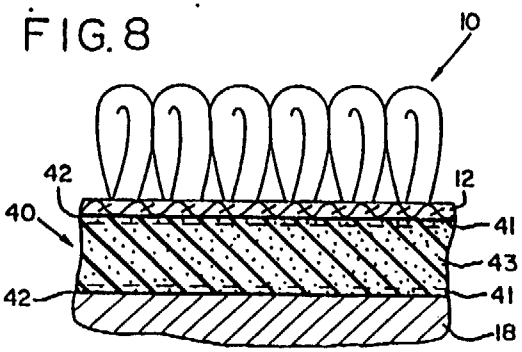
Figure 7:
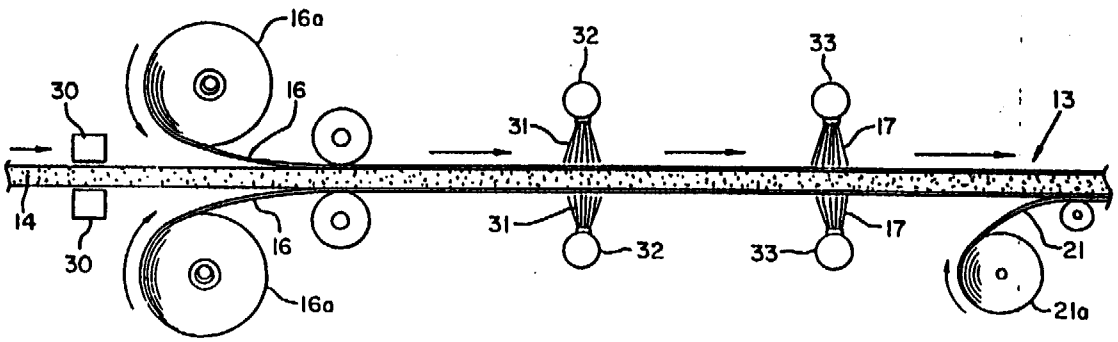

As indicated in FIG. 7, in the manufacture of the adhesive carpet cushion 13, the scrim webbing 16 is bonded to both sides of the foam sheet 14, preferably as the foam pad 13 is being formed. The webbing 16*b* may be bonded to the surfaces of the pad 14 by a heat bonding process, as by heaters indicated at 30, so that it is fused into the surfaces of the foam pad during the manufacturing process, or it may be bonded by other suitable means such as adhesives. In any event, a sealant 31 preferably is applied, as by liquid application or spraying by spray nozzles 32 on both surfaces of the pad with the webbing attached. This substantially closes the porosity of the foam at the surfaces. Next, an adhesive 17 such as hot melt adhesive is applied to the webbing and foam surfaces, as by sprayers 33, and the adhesive does not penetrate into the foam due to the prior application of the sealant.

The release film 21 is next applied to one side of the carpet cushion 13, temporarily bonding to the adhesive on that side. Preferably, all of these operations are accomplished in a continuous process wherein the foam 14, scrim webbing 16 and release film 21 are advanced off roll stock 16*a* and 21*a* as schematically indicated in FIG. 7. The sealant and adhesive are applied at appropriate points in the operation, and the final product emerges complete and is stored in rolls 19 similar to that shown in FIG. 2.

Figure 8:
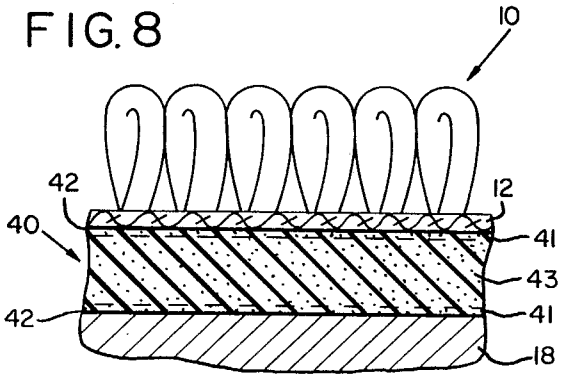
FIG. 8 is a view similar to FIG. 1, but showing another form of carpet and pad installation according to the invention.

In FIG. 8 a carpet 10 and pad installation is shown, using a modified form of adhesive cushion 40 according to another embodiment of the invention. The cushion 40 has no scrim webbing on either surface, but instead relies on a stiffness or "crust" 41 on each surface, with the adhesive 42 applied to these higher-density surfaces 41.

The cushion 40 preferably comprises a high-density urethane foam 43, which when heat-cured forms a skin or crust 41 of increased density. The skin 41 is dense enough that it seals the surfaces and closes the porosity, obviating the need for any sealant 31 (FIG. 7). With this skin, the adhesive 42 will not wick into the foam 43. Also, the skin is stiff enough to provide the required dimensional stability.

The foam cushion 40 may be either flat-surfaced or waffle-surfaced. A waffled surface may be preferable in that it uses less adhesive if the adhesive is rolled (rather than sprayed) onto the surface.

It should be understood that an adhesive carpet cushion according to the invention can be formed with scrim webbing on one or both surfaces, or none. Dimensional stability can be achieved with scrim on one surface only. If one surface has the scrim, it normally is the lower surface in the installation, since at that surface it is more important that the pad be removable from the floor without damage to the pad or the floor.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. A carpet pad for installation between a floor and a carpet, for retaining the carpet and pad in place by adhesion without need for stretching, comprising:

a pad with upper and lower surfaces and of such thickness, density and compressibility as to enable it to serve as a carpet padding;

a scrim webbing on at least the lower surface of the pad for maintaining dimensional stability of the pad, with means for retaining the scrim webbing to the pad;

a sealant applied to both surfaces of the pad; and pressure-sensitive adhesive on both surfaces of the pad for adhering to a floor and to the underside of a carpet to hold the carpet and pad in position while allowing for temporary lifting of the carpet wholly or in localized areas when desired.

2. The carpet pad of claim 1, further including a removable release film on one side of the pad, to facilitate roll storage and for manipulating a carpet on the laid pad, before adhering the carpet to the pad.

3. The carpet pad of claim 1, with the scrim webbing on both surfaces of the foam pad.

4. The carpet pad of claim 1, wherein the pressure-sensitive adhesive is in spaced strips on the surfaces of the pad.

5. The carpet pad of claim 4, wherein the spacing between the strips of adhesive is not more than two inches.

6. The carpet pad of claim 1, wherein the pad is urethane foam.

7. A method of manufacturing an adhesive carpet pad for installation between a floor surface and a carpet for retaining the carpet and pad in place by adhesion without stretching, comprising:

applying and retaining to a foam pad of such thickness, density and compressibility as to enable it to serve as a carpet padding, a scrim webbing on both surfaces of the foam pad, for maintaining dimensional stability of the foam pad;

applying a sealant to both surfaces of the foam pad;

applying a non-permanent pressure-sensitive adhesive to both surfaces of the foam pad; and adhering a release film to the adhesive on one side of the pad so the carpet pad can be stored in a roll.

8. A method of installing a carpet with a carpet cushion, comprising:

positioning a carpet cushion on a floor surface and trimming as required, said carpet cushion having a pressure-sensitive adhesive on its upper and lower surfaces and a removable release film on the pressure-sensitive adhesive on the upper surface, and the carpet cushion including means for maintaining dimensional stability in the carpet cushion;

positioning the carpet on top of the release film on the carpet cushion and cutting and seaming the carpet as required;

folding back the carpet and removing the release film from the exposed area of the carpet cushion;

pressing the carpet down onto the exposed pressure-sensitive adhesive on the upper surface of the carpet cushion;

folding back another portion of the carpet and removing the release film from that area and then pressing that portion of the carpet onto the exposed pressure-sensitive adhesive of the carpet cushion; and performing final trimming at the carpet edges as required when the entire carpet has contacted the adhesive.

9. The invention defined in claim 8, including installing rigid spacer strips on the floor along the walls of the room prior to laying the carpet cushion.

10. The invention defined in claim 9, wherein the rigid spacer strips have pressure-sensitive adhesive on their upper and lower surfaces.

11. The invention defined in claim 8, wherein the pressure-sensitive adhesive is in spaced strips on the surfaces of the carpet cushion.

12. The invention defined in claim 11, further including stapling the carpet cushion to the floor as needed prior to positioning the carpet on the release film of the carpet cushion, the stapling being done between the spaced strips of adhesive on the upper surface of the carpet cushion so that dimples formed in the carpet cushion at the stapling will occur in areas devoid of adhesive, whereby the carpet will span the dimples without adhering into them.

13. The invention defined in claim 11, wherein the spaced strips are in a serpentine configuration.

14. The invention defined in claim 8, wherein the means for maintaining dimensional stability comprises a scrim webbing retained on at least the lower surface of the carpet cushion.

15. The invention defined in claim 8, wherein the means for maintaining dimensional stability comprises a heat formed skin of increased density at the upper and lower surface of the carpet cushion, the cushion comprising a high density urethane foam.

16. A carpet and pad installation, retained in place on a floor surface by adhesion, without need for stretching, comprising:

a carpet cushion in contact with the floor surface, the cushion being of such thickness, density and compressibility as to enable it to serve as a carpet cushion, with pressure-sensitive adhesive on the lower surface of the carpet cushion bonding it to the floor surface, and with pressure-sensitive adhesive on the upper surface of the carpet cushion;

means for maintaining dimensional stability in the carpet cushion; and a carpet laid on the upper surface of the carpet cushion and bonded thereto by the pressure-sensitive adhesive, said adhesive being non-permanent and allowing for temporary lifting of the carpet wholly or in localized areas when desired.

17. The invention defined in claim 16, wherein the carpet has a primary backing as its only backing.

18. A carpet pad for installation between a floor and a carpet, for retaining the carpet and pad in place by adhesion without need for stretching, comprising:

a high-density urethane foam pad, of such thickness, density and compressibility as to enable it to be used as a carpet padding, and with upper and lower surfaces;

a heat-formed crust or skin of increased density on the surfaces of the foam pad for maintaining dimensional stability of the foam pad, and for sealing the porosity of the foam pad at the surfaces; and pressure-sensitive adhesive on both surfaces of the foam pad for adhering to a floor and to the underside of a carpet to hold the carpet and pad in position while allowing for temporary lifting of the carpet wholly or in localized areas when desired.

19. The carpet pad of claim 18, further including a removable release film on one side of the pad, to facilitate roll storage and for manipulating a carpet on the laid pad, before adhering the carpet to the pad.

20. The carpet pad of claim 18, wherein the pressure-sensitive adhesive is in spaced strips on the surfaces of the pad.

21. The carpet pad of claim 18, wherein the surfaces of the foam pad are waffled, the adhesive being rolled on, so that less adhesive is required.

* * * * *

REEXAMINATION CERTIFICATE (1299th)

United States Patent [19] [11] B1 4,557,774

Hoopengardner [45] Certificate Issued Jun. 5, 1990

[54] SYSTEM FOR HOLDING CARPET IN PLACE WITHOUT STRETCHING

[75] Inventor: Merle R. Hoopengardner, Lafayette, Calif.

[73] Assignee: Jactac, Inc.

Reexamination Request:
No. 90/001,692, Jan. 20, 1989

Reexamination Certificate for:

| | |
|---|---|
| Patent No.: | **4,557,774** |
| Issued: | **Dec. 10, 1985** |
| Appl. No.: | **647,119** |
| Filed: | **Sep. 4, 1984** |

[51] Int. Cl.[5] ..... E04B 2/00; E04F 13/00; B32B 5/14; B32B 7/12

[52] U.S. Cl. ..... 156/71; 156/92; 156/291; 428/95; 428/198; 428/317.3; 428/318.8; 428/354; 428/906

[58] Field of Search ..... 156/71, 92, 291; 428/95, 198, 317.3, 318.8, 354, 906

[56] References Cited

FOREIGN PATENT DOCUMENTS 7124118 6/1971 Fed. Rep. of Germany ... 428/317.3

*Primary Examiner*—William J. Van Balen

[57] ABSTRACT

A carpet and pad installation avoids the need for stretching and tackless strips by utilizing a pad with pressure-sensitive adhesive on its upper and lower surfaces. The pad is first laid on the floor surface and trimmed as required, with its lower adhesive surface adhering to the floor. Its upper surface has a removable release film covering the pressure-sensitive adhesive, permitting the carpet to be unrolled over the release film and then cut and seamed as required. The seamed carpet is folded back and the release film is removed from the exposed area of the carpet cushion, then the carpet is pressed down onto the exposed area of adhesive. Then another portion of the carpet is folded back, the release film is removed from that area, and that portion of the carpet is pressed onto the exposed pressure-sensitive adhesive of the carpet cushion.

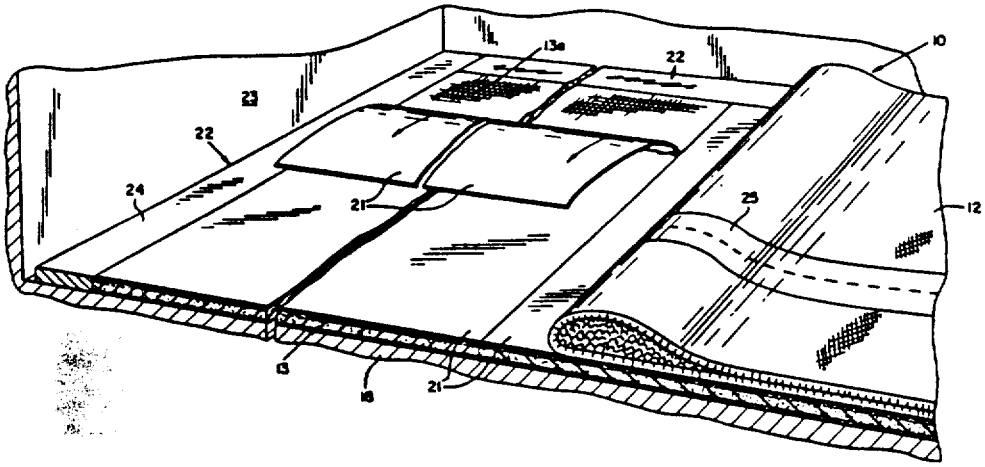

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 11 through 13:

It is a primary object of the present invention to hold *wall-to-wall* carpet in place without stretching by a system that avoids the problems of the prior art.

Column 2, lines 17 through 21:

By the method of the present invention, *wall-to-wall* carpeting is efficiently and economically installed without stretching or the need for tackless strips and without liquid glues or spray adhesives, but still with the benefit of a carpet cushion or pad between the floor and the carpet.

Column 4, lines 53 through 65:

FIG. 3 illustrates some aspects of the installation operation according to the *wall-to-wall carpet installing* system of the invention. First, rigid spacer strips 22 may be installed around the edges of the room near the walls 23. The spacer strips 22 may be of wood or plastic, for example, with a pressure-sensitive adhesive 24 on both the upper and lower surfaces. The purpose of the strip 24 is merely to take the place of the conventional tackless strips, in the sense that conventional carpeting tools for trimming the finished carpet are designed to be used along the edges of the tackless strips. If tackless strips are in place from a prior carpet installation, they should be left intact, and the spacer strips 22 would then not be needed.

AS A RESULT OF REEXAMINATION IT HAS BEEN DETERMINED THAT:

The patentability of claims 8–15 and 18–21 is confirmed.

Claim 7 is cancelled.

Claims 1 and 16 are determined to be patentable as amended.

Claims 2–6 and 17 dependent on an amended claim, are determined to be patentable.

New claim 22 is added and determined to be patentable.

1. A carpet pad for installation between a floor and a carpet *in a wall-to-wall carpet installation*, for retaining the *wall-to-wall* carpet and pad in place by adhesion without need for stretching, comprising:

a pad with upper and lower surfaces and of such thickness, density and compressibility as to enable it to serve as a carpet padding;

a scrim webbing on at least the lower surface of the pad for maintaining dimensional stability of the pad, with means for retaining the scrim webbing to the pad;

a sealant applied to both surfaces of the pad; and pressure-sensitive adhesive on both surfaces of the pad *with sufficient tackiness* for adhering to a floor and to the underside of a carpet to hold *and bond* the carpet and pad *securely* in position while allowing for temporary lifting of the carpet wholly or in localized areas when desired.

16. A *wall-to-wall* carpet and pad installation, retained in place on a floor surface by adhesion, without need for stretching, comprising:

a carpet cushion in contact with the floor surface, the cushion being of such thickness, density and compressibility as to enable it to serve as a carpet cushion, with *pre-applied* pressure-sensitive adhesive on the lower surface of the carpet cushion bonding it to the floor surface, and with *pre-applied* pressure-sensitive adhesive on the upper surface of the carpet cushion;

means for maintaining dimensional stability in the carpet cushion; and a carpet laid on the upper surface of the carpet cushion and bonded thereto by the pressure-sensitive adhesive, said adhesive being non-permanent and allowing for temporary lifting of the carpet wholly or in localized areas when desired.

*22. A wall-to-wall carpet and pad installation, retained in place on a floor surface by adhesion, without stretching, comprising:*

*a carpet cushion in contact with the floor surface, the carpet cushion being of such thickness, density and compressibility as to enable it to serve as a carpet cushion, with pre-applied pressure-sensitive adhesive on the lower surface of the carpet cushion bonding it to the floor surface, and with pre-applied pressure-sensitive adhesive on the upper surface of the cushion;*

*a scrim webbing at least on the lower surface of the carpet cushion, bonded to the carpet cushion;*

*a carpet laid on the upper surface of the carpet cushion and bonded thereto by the pressure-sensitive adhesive; and*

*said adhesive having sufficient tackiness and bonding strength to securely bond the wall-to-wall carpet and pad in place on the floor surface.*

* * * * *

US004557774B1

REEXAMINATION CERTIFICATE (2473rd)

United States Patent [19]

Hoopengardner

[11] B2 4,557,774

[45] Certificate Issued Feb. 14, 1995

[54] SYSTEM FOR HOLDING CARPET IN PLACE WITHOUT STRETCHING

[75] Inventor: Merle R. Hoopengardner, Lafayette, Calif.

[73] Assignee: Step Loc Corporation

Reexamination Request:
No. 90/002,341, May 7, 1991

Reexamination Certificate for:

| | |
|---|---|
| Patent No.: | **4,557,774** |
| Issued: | **Dec. 10, 1985** |
| Appl. No.: | **647,119** |
| Filed: | **Sep. 4, 1984** |

Reexamination Certificate B1 4,557,774 issued Jun. 5, 1990.

[51] Int. Cl.[6] ..... E04B 2/00; B32B 5/13; B32B 7/12

[52] U.S. Cl. ..... 156/71; 156/90; 156/92; 156/256; 156/291; 428/95; 428/198; 428/317.3; 428/318.8; 428/354; 428/906

[58] Field of Search ..... 428/95, 40, 354, 317.3, 428/317.1, 354; 156/71, 90, 256

[56] References Cited

U.S. PATENT DOCUMENTS

| | | | |
|---|---|---|---|
| 2,057,873 | 10/1936 | Atwood | 428/40 |
| 2,487,060 | 11/1949 | Pike et al. | 428/317.3 |
| 2,605,514 | 8/1952 | Eshenaur et al. . | |
| 2,638,638 | 5/1953 | McBride | 156/71 |
| 2,999,041 | 9/1961 | Lappala | 428/317.1 |
| 3,014,829 | 12/1961 | Curtin | 428/82 |
| 3,039,907 | 6/1962 | Scholl | 428/40 |
| 3,074,835 | 1/1963 | Gordon | 428/82 |
| 3,120,083 | 2/1964 | Dahlberg et al. | 428/95 |
| 3,196,315 | 7/1965 | Peterson | 428/95 |
| 3,311,338 | 3/1967 | Culley | 428/354 |
| 3,394,043 | 7/1968 | Parlin et al. | 428/95 |
| 3,402,094 | 9/1968 | Levitch | 428/80 |
| 3,531,342 | 9/1970 | Dorn | 156/71 |
| 3,586,598 | 6/1971 | Beemer . | |
| 3,591,443 | 7/1971 | Cox | 428/314.4 |
| 3,616,029 | 10/1971 | Lerman | 428/316.6 |
| 3,847,647 | 11/1974 | Bahlo | 428/47 |
| 3,952,133 | 4/1976 | Amos et al. | 428/354 |
| 4,075,377 | 2/1978 | Aitchison et al. | 428/95 |
| 4,100,006 | 7/1978 | Buckley | 428/319.7 |
| 4,114,346 | 9/1978 | Kelly | 156/71 |
| 4,161,558 | 7/1979 | See | 428/95 |
| 4,234,649 | 11/1980 | Ward | 428/255 |
| 4,242,389 | 12/1980 | Howell | 428/40 |
| 4,360,554 | 11/1982 | Campbell et al. | 428/95 |
| 4,405,668 | 9/1983 | Wald | 428/40 |
| 4,504,537 | 3/1985 | Mussallem, Jr. | 428/95 |
| 4,522,857 | 6/1985 | Higgins | 428/82 |
| 4,554,194 | 11/1985 | Haas et al. | 428/95 |
| 4,578,300 | 3/1986 | Merlet | 428/91 |
| 4,595,617 | 6/1986 | Bogdany | 428/95 |
| 4,647,484 | 3/1987 | Higgins | 428/40 |
| 4,702,948 | 10/1987 | Siebe-Gadient | 428/40 |

FOREIGN PATENT DOCUMENTS

| | | | |
|---|---|---|---|
| 747341 | 11/1966 | Canada | 428/354 |
| 7124118.4 | 6/1971 | Germany | 428/317.3 |
| 7124118 | 6/1971 | Germany | 428/317.3 |
| 788001 | 12/1957 | United Kingdom | 428/352 |
| 840210 | 7/1960 | United Kingdom | 428/317.3 |
| 900876 | 7/1962 | United Kingdom | 428/319.1 |
| 1032868 | 6/1966 | United Kingdom | 428/318.6 |
| 1416684 | 12/1975 | United Kingdom | 52/746 |

OTHER PUBLICATIONS

Tred Mor & Scottdel glue-down instructions, 2 pp. (no date).

*Primary Examiner*—Jenna Davis

[57] ABSTRACT

A carpet and pad installation avoids the need for stretching and tackless strips by utilizing a pad with pressure-sensitive adhesive on its upper and lower surfaces. The pad is first laid on the floor surface and trimmed as required, with its lower adhesive surface adhering to the floor. Its upper surface has a removable release film covering the pressure-sensitive adhesive, permitting the carpet to be unrolled over the release film and then cut and seamed as required. The seamed carpet is folded back and the release film is removed from the exposed area of the carpet cushion, then the carpet is pressed down onto the exposed area of adhesive. Then another portion of the carpet is folded back, the release film is removed from that area, and that portion of the carpet is pressed onto the exposed pressure-sensitive adhesive of the carpet cushion.

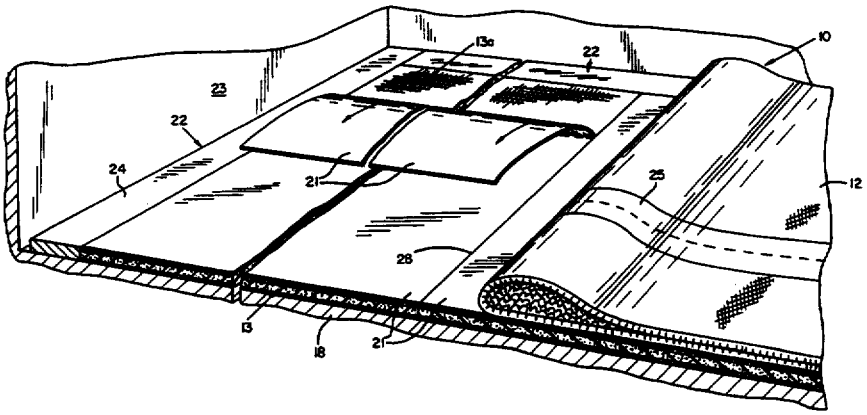

FIG. 1
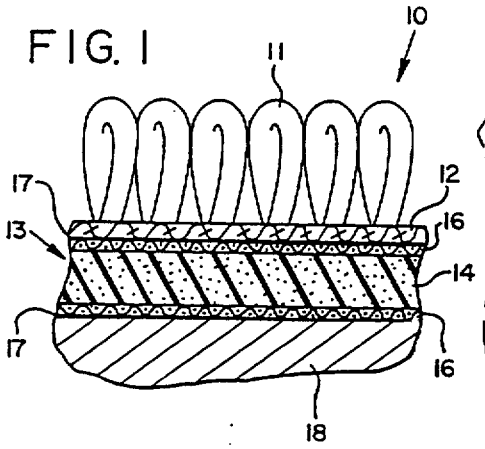
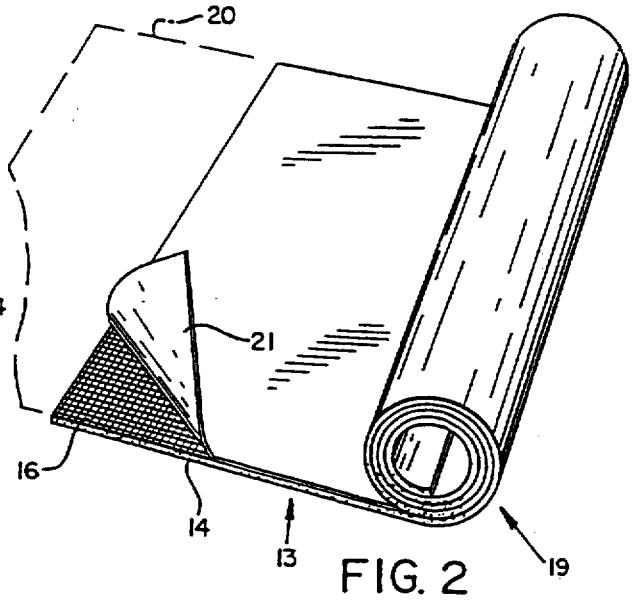
FIG. 2
FIG. 3
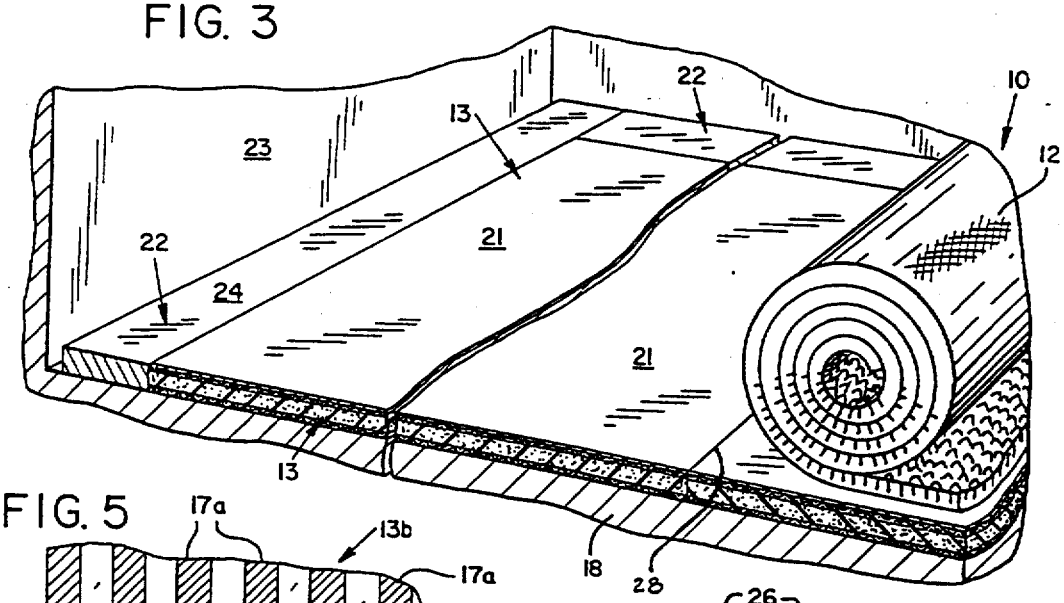
FIG. 5
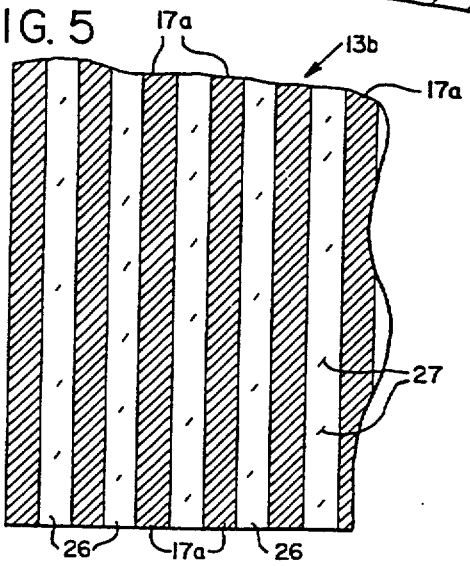
FIG. 6
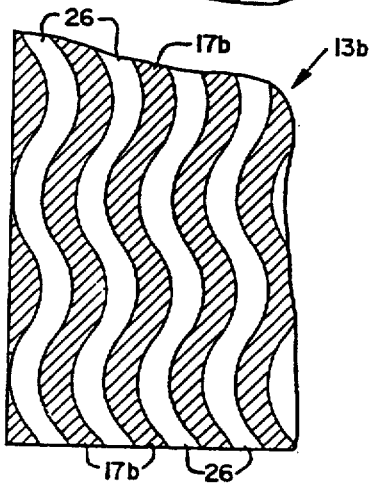

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, lines 14–24:

In the drawings, FIG. 1 shows a carpet 10 with a pile 11 and a single backing layer or primary backing 12 laid on a pad or carpet cushion 13 comprising a foam pad 14 and a scrim webbing 16 bonded to both top and bottom surfaces of the pad 14, with a pressure-sensitive adhesive layer 17 also at top and bottom surfaces on the scrim 16 and on the surfaces of the pad 14 itself, between the mesh of the scrim webbing. The adhesive 17 holds the carpet backing 12 to the carpet cushion 13, and the carpet cushion to the surface of the floor 18 below. *Thus the installation holds the carpet 10 bonded to the carpet cushion 13 at a raised position above the floor surface with the thickness, density and compressibility of the carpet cushion 13 between the carpet 10 and the floor 18.*

Column 5, lines 8–13:

As indicated in FIG. 3, the adhesive carpet cushion 13 is first laid and trimmed on the floor 18, with its lower side adhered to the floor 18 but the release film 21 remaining on the upper surface. *FIGS. 3 and 4 show that the adhesive carpet cushion 13 is of sufficient length to extend from wall to wall across the floor 18, and a plurality of lengths of the carpet cushion 13 are laid side-by-side as indicated, as necessary to reach across the other dimension of the floor 18. After trimming of the carpet cushion 13,* [The] *the* carpet 10 is then unrolled over the top of the release film, and seaming and preliminary cutting is performed as necessary, *with carpet seams 25 offset from carpet cushion seams 28 as shown in FIGS. 3 and 4, i.e. the carpet seam 25 is not aligned over the seam 28 in the carpet cushion 13 below.*

Column 5, lines 52–68:

As indicated in FIG. 7, in the manufacture of the adhesive carpet cushion 13, the scrim webbing 16 is bonded to both sides of the foam sheet 14, preferably as the foam pad 13 is being formed. The webbing 16[b] may be bonded to the surfaces of the pad 14 by a heat bonding process, as by heaters indicated at 30, so that it is fused into the surfaces of the foam pad during the manufacturing process, or it may be bonded by other suitable means such as adhesives. In any event, a sealant 31 preferably is applied, as by liquid application or spraying by spray nozzles 32 on both surfaces of the pad with the webbing attached. This substantially closes the porosity of the foam at the surfaces. Next, an adhesive 17 such as hot melt adhesive is applied to the webbing and foam surfaces, as by sprayers 33, and the adhesive does not penetrate into the foam due to the prior application of the sealant.

Reference No. 28 has been added to FIG. Nos. 3 & 4.

AS A RESULT OF REEXAMINATION, IT HAS BEEN DETERMINED THAT:

Claim 7, was previously cancelled.

Claims 12, 16–17, and 22 are cancelled.

Claims 1, 8 and 18 are determined to be patentable as amended.

Claims 2–6, 9–11, 13–15, 19–21 dependent on an amended claim, are determined to be patentable.

New claims 23 and 24 are added and determined to be patentable.

1. A carpet pad *in rolled form* for installation between a floor and a carpet in a wall-to-wall carpet installation, for retaining the wall-to-wall carpet and pad in place by adhesion without need for stretching, *the wall-to-wall carpet being joined together at seams as required to extend from wall to wall,* [comprising] *consisting essentially of:* a *rolled* pad with upper and lower surfaces and of such thickness, density and compressibility as to enable it to serve as a carpet padding, *the pad having a nominal width and an indeterminate length, and the pad being of sufficeint length and width to allow it use in installation of wall-to-wall carpet, the length being at least sufficient to extend from wall to wall in a room to be carpeted;* a scrim webbing on at least the lower surface of the pad [for] maintaining dimensional stability of the pad, with means for retaining the scrim webbing to the pad;

a sealant applied to both surfaces of the pad; and pressure-sesnitive adhesive on both surfaces of the pad [with] , *the adhesive having* sufficient tackiness for adhering to a floor and to the underside of a carpet to hold and bond the carpet and pad securely in position while allowing for temporary lifting of the carpet wholly or in localized areas when desired.

8. A method of installing a *wall-to-wall* carpet with a carpet cushion *onto a floor surface,* comprising:

*using the carpet cushion itself both (i) to cushion the carpet and (ii) to hold the carpet in place on the cushion and the cushion in place on the floor surface, by the steps of:*

[positioning] *(a) placing* a *roll-stored* carpet cushion on a floor surface and *unrolling the cushion onto the floor surface to cover the floor from wall to wall, including unrolling a plurality of lengths of the cushion side by side as required, the lengths of cushion being abutted at seams, and* trimming as required, said carpet cushion having a pressure-sensitive adhesive on its upper and lower surfaces and a removable release film on the pressure-sensitive adhesive on the upper surface *only,* and the carpet cushion including means for maintaining dimensional stability in the carpet cushion, *and the carpet cushion being of sufficient length and width to allow its efficient use in installation of wall-to-wall carpet,*

*as well as being of sufficient length to extend from wall to wall across the floor surface;*

(*b*) *adhering the carpet cushion to the floor surface with the exposed pressure sensitive adhesive carried on the lower surface of the carpet cushion;*

(*c*) positioning the carpet on top of the release film on the carpet cushion and cutting and seaming the carpet as required, *while offsetting any seams in the carpet from seams in the carpet cushion below;*

(*d*) folding back the carpet and removing the release film from the exposed area of the carpet cushion;

(*e*) pressing the carpet down *against the compressibility of the carpet cushion,* onto the exposed pressure-sensitive adhesive on the upper surface of the carpet cushion *and holding the carpet bonded to the carpet cushion at a raised position above the floor surface with the thickness, density and compressibility of the carpet cushion between the carpet and the floor surface thus cushioning the carpet;*

(*f*) folding back another portion of the carpet and removing the release film from that area and then pressing that portion of the carpet onto the exposed pressure-sensitive adhesive of the carpet cushion *as in step* (*e*); and (*g*) performing final trimming at the carpet edges as required when the entire carpet has contacted the adhesive.

18. A carpet pad for installation between a floor and a carpet, for retaining the carpet and pad in place by adhesion without need for stretching [comprising] *consisting essentially of:* a high density urethane foam pad, of such thickness, density and compressibility as to enable it to be used as a carpet padding, [and] with upper and lower surfaces, *and the foam pad being of sufficient length and width to allow its efficient use in installation of wall-to-wall carpet, the pad being roll-stored and of sufficient length to extend from wall to wall in a room to be carpeted;*

*means for maintaining dimensional stability of the foam pad as well as for sealing the porosity of the foam pad at the surfaces, comprising* a heat-formed crust or skin of increased density on the surfaces of the foam pad [for maintaining dimensional stability of the foam pad, and for sealing the porosity of the foam pad at the surfaces]; and pressure-sensitive adhesive on both surfaces of the foam pad [for] *capable of* adhering *the pad* to a floor and to the underside of a carpet to hold the carpet and pad in position while allowing for temporary lifting of the carpet wholly or in localized areas when desired.

*23. A carpet pad in rolled form for installation between a floor and a carpet in a wall-to-wall carpet installation, for retaining the wall-to-wall carpet and pad in place by adhesion without need for stretching, the wall-to-wall carpet being joined together at seams as required to extend from wall to wall, consisting essentially of:*

*a pad with upper and lower surfaces and of such thickness, density and compressibility as to enable it to serve as a carpet padding, the pad being of sufficient length and width to allow its use in installation of wall-to-wall carpet, and the pad being roll-stored and of at least sufficient length to extend from wall to wall in a room to be carpeted;*

*a scrim webbing on at least the lower surface of the pad maintaining dimensional stability of the pad, with means for retaining the scrim webbing to the pad;*

*a sealant applied to both surfaces of the pad, substantially closing porosity of the pad surfaces; and*

*pressure-sensitive adhesive on both surfaces of the pad, the adhesive having sufficient tackiness for adhering to a floor and to the underside of a carpet to hold and bond the carpet and pad securely in position while allowing for temporary lifting of the carpet wholly or in localized areas when desired.*

*24. A method of installing a wall-to-wall carpet with a carpet cushion onto a floor surface, comprising:*

*using the carpet cushion itself both (i) to cushion the carpet and (ii) to hold the carpet in place on the cushion and the cushion in place on the floor surface, by the steps of:*

*(a) placing a roll-stored carpet cushion on a floor surface and unrolling the cushion onto the floor surface as a plurality of lengths abutted at lateral seams, and trimming as required, said carpet cushion having a pressure-sensitive adhesive on its upper and lower surfaces and a removable release film on the pressure-sensitive adhesive on the upper surface, the carpet cushion having such thickness, density and compressibility as to function as a carpet cushion and including means for maintaining dimensional stability in the carpet cushion, and the carpet cushion being of sufficient length and width to allow its efficient use in installation of wall-to-wall carpet, the length being sufficient to extend from wall to wall across the floor surface;*

*(b) adhering the carpet cushion to the floor surface with the exposed pressure sensitive adhesive carried on the lower surface of the carpet cushion;*

*(c) positioning the carpet on top of the release film on the carpet cushion and cutting and seaming the carpet as required while offsetting seams in the carpet from seams in the carpet cushion below;*

*(d) folding back the capret and removing the release film from the exposed area of the carpet cushion;*

*(c) pressing the carpet down against the compressibility of the carpet cushion, onto the exposed pressure-sensitive adhesive on the upper surface of the carpet cushion and holding the carpet bonded to the carpet cushion at a raised position above the floor surface with the thickness, density and compressibility of the carpet cushion between the carpet and the floor surface and thus cushioning the carpet;*

*(f) folding back another portion of the carpet and removing the release film from that area and then pressing that portion of the carpet onto the exposed pressure-sensitive adhesive of the carpet cushion as in step (e), and*

*(g) performing final trimming at the carpet edges as required when the entire carpet has contacted the adhesive.*

* * * * *